US007445302B2

(12) United States Patent
Edwards et al.

(10) Patent No.: US 7,445,302 B2
(45) Date of Patent: Nov. 4, 2008

(54) METHOD FOR DETERMINING A PRINTHEAD GAP IN AN INK JET APPARATUS THAT PERFORMS BI-DIRECTIONAL ALIGNMENT OF THE PRINTHEAD

(75) Inventors: Mark J. Edwards, Lexington, KY (US); Brian K. Owens, Lexington, KY (US); Ricky E. Robbins, Danville, KY (US)

(73) Assignee: Lexmark International, Inc, Lexington, KY (US)

( * ) Notice: Subject to any disclaimer, the term of this patent is extended or adjusted under 35 U.S.C. 154(b) by 287 days.

(21) Appl. No.: 11/232,058

(22) Filed: Sep. 21, 2005

(65) Prior Publication Data

US 2007/0064029 A1 Mar. 22, 2007

(51) Int. Cl.
*B41J 53/308* (2006.01)

(52) U.S. Cl. ..... 347/8; 347/19; 347/9

(58) Field of Classification Search ..... 347/8, 347/19, 9–12, 5, 14; 400/74, 118.2
See application file for complete search history.

(56) References Cited

U.S. PATENT DOCUMENTS 4,990,932 A 2/1991 Houston
5,250,956 A * 10/1993 Haselby et al. ..... 347/19
5,448,269 A * 9/1995 Beauchamp et al. ..... 347/19
5,683,187 A 11/1997 Tunmore
6,273,536 B1 * 8/2001 Nozawa ..... 347/8
6,523,921 B2 2/2003 Codos
6,543,874 B2 4/2003 Matsumoto
6,626,511 B2 9/2003 Riou
6,629,787 B2 10/2003 Lee et al.
6,631,971 B2 10/2003 Adkins et al.
6,767,088 B2 7/2004 Sarmast
6,840,598 B2 1/2005 Fairchild et al.
2004/0080553 A1 4/2004 Kim
2004/0100512 A1 5/2004 Codos
2004/0155914 A1 8/2004 Nellen et al.
2004/0212644 A1 10/2004 Kwang et al.

* cited by examiner

*Primary Examiner*—Lam S Nguyen
(74) *Attorney, Agent, or Firm*—Taylor & Aust. PC

(57) ABSTRACT

A method for determining a printhead gap between a printhead and a sheet of media in an ink jet apparatus that performs bi-directional alignment of the printhead includes determining a first amount of bi-directional misalignment of the printhead at a first unknown printhead gap; changing the printhead gap from the first unknown printhead gap to a second unknown printhead gap by a known printhead gap change amount; determining a second amount of bi-directional misalignment of the printhead at the second unknown printhead gap; and calculating at least one of the first unknown printhead gap and the second unknown printhead gap based on the first amount of bi-directional misalignment, the second amount of bi-directional misalignment, and the known printhead gap change amount.

20 Claims, 4 Drawing Sheets

METHOD FOR DETERMINING A PRINTHEAD GAP IN AN INK JET APPARATUS THAT PERFORMS BI-DIRECTIONAL ALIGNMENT OF THE PRINTHEAD

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present invention relates generally to an ink jet apparatus, and more particularly to a method for determining a printhead gap between a printhead and a sheet of media in an ink jet apparatus that performs bi-directional alignment of the printhead.

2. Description of the Related Art

In prior art, an ink jet printer forms an image on a sheet of media, such as paper, by positioning a printhead in close proximity with the recording medium, and selectively ejecting ink from a plurality of ink jetting nozzles of the printhead to form a pattern of ink dots on the recording medium. During ink jet printing, the printhead is spaced apart from the recording medium in a plane perpendicular to the sheet of media. As the printhead is moved across the sheet of media, from one end to another in a scan direction, ink is selectively ejected from the ink jetting nozzles to form a print swath. After completing at least one print swath, the sheet of media is indexed a selected amount in a sub scan, i.e., paper feed, direction.

Print quality is affected by the bi-directional alignment of a printhead. Bi-directional alignment is performed so that an ink drop may be placed in an exact location, within an accepted tolerance, regardless of whether the ink drop is ejected from the printhead in the forward scan of the printhead or the return scan of the printhead along a bi-directional scan path. Bi-directional alignment is typically performed by printing an alignment pattern with a printhead in both the forward and return scan directions along the bi-directional scan path. The alignment pattern is then read by a sensor, such as a bi-directional alignment sensor, to collect data relating to the placement of ink drops forming the alignment pattern.

Also, a relationship exists between print quality and the spacing, or gap, between the ink jet printhead to the sheet of media, and it is desirable for the printhead to maintain a certain spacing, or gap, relative to the sheet of media. Various factors may influence the size of the gap, including tolerance stack up of manufactured parts, intentional or unintentional variation in recording medium thickness or weight, ambient thermal and humidity conditions, and settling or shifting of printer components due to shipping and setup at the user's premises.

SUMMARY OF THE INVENTION

The present invention relates to a method for determining a printhead gap between a printhead and a sheet of media in an ink jet apparatus.

The present invention, in one form thereof, is directed to a method for determining a printhead gap between a printhead and a sheet of media in an ink jet apparatus that performs bidirectional alignment of the printhead. The method includes determining a first amount of bi-directional misalignment of the printhead at a first unknown printhead gap; changing the printhead gap from the first unknown printhead gap to a second unknown printhead gap by a known printhead gap change amount; determining a second amount of bi-directional misalignment of the printhead at the second unknown printhead gap; and calculating at least one of the first unknown printhead gap and the second unknown printhead gap based on the first amount of bi-directional misalignment, the second amount of bi-directional misalignment, and the known printhead gap change amount.

The present invention, in another form thereof, is directed to a method for determining a printhead gap between a printhead and a sheet of media in an ink jet apparatus that performs bi-directional alignment of the printhead. The method includes printing a first bi-directional printhead alignment pattern; reading the first bi-directional printhead alignment pattern with a printhead alignment sensor to determine a first amount of bi-directional misalignment of the printhead at a first unknown printhead gap associated with the first bi-directional printhead alignment pattern; changing the printhead gap from the first unknown printhead gap to a second unknown printhead gap by a known printhead gap change amount; printing a second bi-directional printhead alignment pattern; reading the second bi-directional printhead alignment pattern with the printhead alignment sensor to determine a second amount of bi-directional misalignment of the printhead at the second unknown printhead gap associated with the second bi-directional printhead alignment pattern; and calculating at least one of the first unknown printhead gap and the second unknown printhead gap based on the first amount of bi-directional misalignment, the second amount of bidirectional misalignment, and the known printhead gap change amount.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
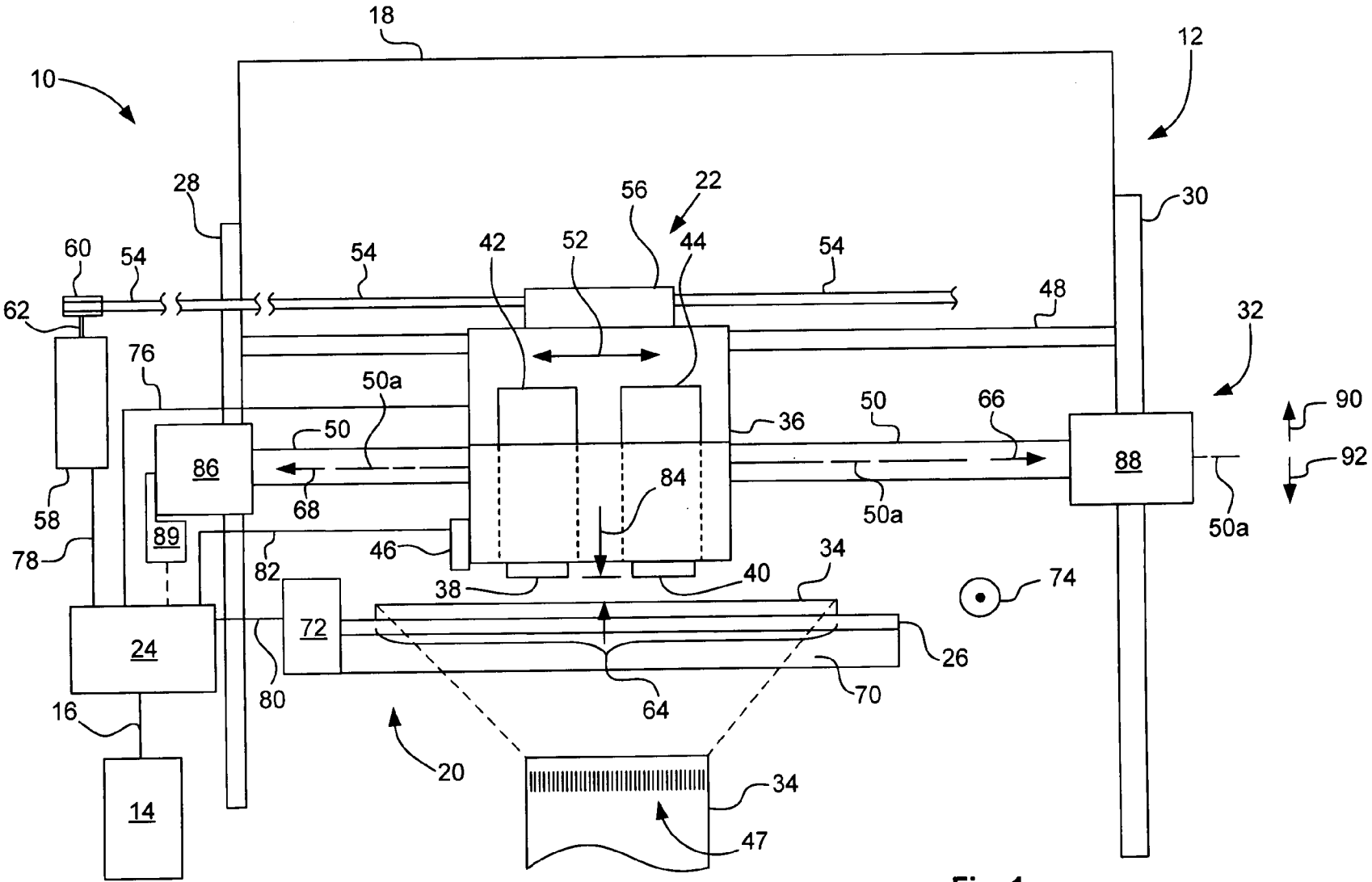
FIG. 1 is a diagrammatic representation of an imaging apparatus embodying the present invention, and including a printhead gap adjustment mechanism.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

In addition, it should be understood that embodiments of the invention include both hardware and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software. As such, it should be noted that a plurality of hardware and software-based devices, as well as a plurality of different structural components may be utilized to implement the invention. Furthermore, and as described in subsequent paragraphs, the specific mechanical configurations illustrated in the drawings are intended to exemplify embodiments of the invention and that other alternative mechanical configurations are possible.

Referring now to the drawings and particularly to FIG. 1, there is shown an imaging system 10 embodying the present invention. Imaging system 10 includes an imaging apparatus in the form of an ink jet apparatus 12, and optionally, an external operator station, such as a computer 14.

Ink jet apparatus 12 may be in the form of an ink jet printer. Alternatively, ink jet apparatus 12 may be in the form of an All-In-One machine (AIO), also sometimes referred to as a multi-function imaging apparatus, and may operate as a standalone unit that has copying, scanning, and/or faxing functionality, in addition to printing.

In embodiments that include computer 14, ink jet apparatus 12 may be communicatively coupled to computer 14 via a communications link 16. As used herein, the term "communications link" generally refers to structure that facilitates electronic communication between two components, and may operate using wired or wireless technology. Accordingly, communications links, such as communications link 16, may be, for example, a direct electrical wired connection, a direct wireless connection (e.g., infrared or r.f.), or a network connection (wired or wireless), such as for example, an Ethernet local area network (LAN) or a wireless networking standard, such as IEEE 802.11.

In embodiments including computer 14, computer 14 may be, for example, a personal computer including a display device, an input device (e.g., keyboard), a processor, input/output (I/O) interfaces, memory, such as RAM, ROM, NVRAM, and a mass data storage device, such as a hard drive, CD-ROM and/or DVD units. During operation, computer 14 includes in its memory a software program including program instructions that function as a printer driver for ink jet apparatus 12. The printer driver is in communication with ink jet apparatus 12 via communications link 16. The printer driver, for example, includes a halftoning unit and a data formatter that places print data and print commands in a format that can be recognized by ink jet apparatus 12. In a network environment, communications between computer 14 and ink jet apparatus 12 may be facilitated via a standard communication protocol, such as the Network Printer Alliance Protocol (NPAP).

In the embodiment of FIG. 1, ink jet apparatus 12 includes a media source 18, a sheet feed unit 20, a printhead carrier system 22, a controller 24, a mid-frame 26, a side frame 28, a side frame 30 and a printhead gap adjustment mechanism 32.

Media source 18 is configured to receive a plurality of sheets of media from which a sheet of media 34 is picked and transported by sheet feed unit 20 during an imaging operation. The sheet of media 34 may be, for example, plain paper, coated paper, photo paper or transparency media.

Printhead carrier system 22 includes a printhead carrier 36 for mounting and carrying a color printhead 38 and/or a monochrome printhead 40. A color ink reservoir 42 is provided in fluid communication with color printhead 38, and a monochrome ink reservoir 44 is provided in fluid communication with monochrome printhead 40. Those skilled in the art will recognize that color printhead 38 and color ink reservoir 42 may be formed as individual discrete units, or may be combined as an integral unitary printhead cartridge. Likewise, monochrome printhead 40 and monochrome ink reservoir 44 may be formed as individual discrete units, or may be combined as an integral unitary printhead cartridge.

Printhead carrier system 22 further includes a printhead alignment sensor 46 attached to printhead carrier 36. Printhead alignment sensor 46 may be used, for example, during scanning of a printhead alignment pattern, such as printhead alignment pattern 47 shown in a projection of the sheet of media 34 in FIG. 1. Printhead alignment sensor 46 may be, for example, a unitary optical sensor including a light source, such as a light emitting diode (LED), and a reflectance detector, such as a phototransistor. The reflectance detector is located on the same side of a media as the light source. The operation of such sensors is well known in the art, and thus, will be discussed herein to the extent necessary to relate the operation of printhead alignment sensor 46 to the operation of the present invention. For example, the LED of printhead alignment sensor 46 directs light at a predefined angle onto a reference surface, such as the surface of sheet of media 34, and at least a portion of light reflected from the surface is received by the reflectance detector of printhead alignment sensor 46. The intensity of the reflected light received by the reflectance detector varies with the density of a printed image present on sheet of media 34. The light received by the reflectance detector of printhead alignment sensor 46 is converted to an electrical signal by the reflectance detector of printhead alignment sensor 46. The signal generated by the reflectance detector corresponds to the reflectivity from sheet of media 34, and the reflectivity of the printhead alignment pattern 47, scanned by printhead alignment sensor 46.

Printhead carrier 36 is guided by a guide member 48 and a guide member 50, which are arranged to be parallel. Guide member 48 may be, for example, a guide rail tab fixedly mounted to side frames 28 and 30. Guide member 50 may be a guide rod that is movably mounted to side frames 28, 30, and in positional communication with printhead gap adjustment mechanism 32. Guide member 50 includes a horizontal axis 50*a*. The horizontal axis 50*a* of guide member 50 generally defines a bidirectional scan path 52, also referred to as main scan direction 52, for printhead carrier 36. Accordingly, horizontal axis 50*a* and bi-directional scan path 52 are associated with each of printheads 38, 40 and printhead alignment sensor 46.

Printhead carrier 36 is connected to a carrier transport belt 54 via a carrier drive attachment device 56. Carrier transport belt 54 is driven by a carrier motor 58 via a carrier pulley 60. Carrier motor 58 has a rotating carrier motor shaft 62 that is attached to carrier pulley 60. Carrier motor 58 may be, for example, a direct current (DC) motor or a stepper motor. At the directive of controller 24, printhead carrier 36 is transported in a reciprocating manner along guide members 48, 50 and in turn, along bi-directional scan path 52.

The reciprocation of printhead carrier 36 transports ink jet printheads 38, 40 and printhead alignment sensor 46 across the sheet of media 34 along bi-directional scan path 52 to define a print/sense zone 64 of ink jet apparatus 12. The reciprocation of printhead carrier 36 occurs along bi-directional scan path 52, and is also commonly referred to as the horizontal direction, including a left-to-right carrier scan direction 66 and a right-to-left carrier scan direction 68. Generally, during each scan of printhead carrier 36 while printing or sensing, the sheet of media 34 is held stationary by sheet feed unit 20.

Mid-frame 26 provides support for the sheet of media 34 when the sheet of media 34 is in print/sense zone 64, and in part, defines a portion of a print medium path of ink jet apparatus 12.

Sheet feed unit 20 includes a feed roller 70 and corresponding index pinch rollers (not shown). Feed roller 70 is driven by a drive unit 72. The index pinch rollers apply a biasing force to hold the sheet of media 34 in contact with the respective driven feed roller 70. Drive unit 72 includes a drive source, such as a stepper motor, and an associated drive mechanism, such as a gear train or belt/pulley arrangement. Sheet feed unit 20 feeds the sheet of media 34 in a forward sheet feed direction 74, designated as a dot in a circle to indicate that the sheet feed direction is out of the plane of FIG. 1 toward the reader. The sheet feed direction 74 is perpendicular to the horizontal bi-directional scan path 52, and in turn, is perpendicular to the horizontal carrier scan directions 66, 68.

Controller 24 may be formed, for example, as an application specific integrated circuit (ASIC), and may include a processor, such as a microprocessor, and associated memory. Controller 24 is communicatively coupled to printheads 38, 40 via a communications link 76. Controller 24 is communicatively coupled to carrier motor 58 via a communications link 78. Controller 24 is communicatively coupled to drive unit 72 via a communications link 80. Controller 24 communicatively coupled to printhead alignment sensor 46 via a communications link 82.

Controller 24 executes program instructions to effect the printing of an image on the sheet of media 34, such as for example, by selecting the index feed distance of sheet of media 34 along forward sheet feed direction 74 as conveyed by feed roller 70, controlling the acceleration rate and velocity of printhead carrier 36, and controlling the operations of printheads 38, 40, such as for example, by controlling the firing frequency of individual nozzles of printhead 38 and/or printhead 40. As used herein, the term "firing frequency" refers to the frequency of successive firings of a nozzle of a printhead in forming adjacent dots on the same scan line of an image.

In addition, controller 24 executes instructions to print printhead alignment patterns on a sheet of print media, such as the sheet of media 34, and to determine compensation values based on a reading of the printhead alignment patterns for reducing dot placement errors during printing, such as for example, for reducing bidirectional dot placement errors by performing bi-directional printhead alignment. Bi-directional printhead alignment may be individually performed on each of printheads 38, 40. One example of a bi-directional printhead alignment pattern 47 is formed by printing a first plurality of laterally spaced bars in scan direction 66, printing a second plurality of laterally spaced bars in scan direction 68 interleaved with the first plurality of laterally spaced bars, determining an amount of bi-directional misalignment of dot placement based on bar spacing and/or overlap, and determining a bi-directional alignment value, e.g., a time delay value, a time advance value, a position delay value, or position advance value, that may be used to represent and correct for the determined amount of bi-directional misalignment.

Printhead gap adjustment mechanism 32 is used to adjust a printhead gap 84, i.e., the spacing, between printheads 38, 40, and the top surface of the sheet of media 34. Printhead gap adjustment mechanism 32 may include, for example, an active adjuster 86, a passive adjuster 88, and a drive mechanism 89. In one embodiment, for example, each of active adjuster 86 and passive adjuster 88 may include an eccentric cam to lift (i.e., move in direction 90) or lower (i.e., move in direction 92) guide member 50, and in turn, raise or lower, respectively, printheads 38, 40 and printhead alignment sensor 46 in relation to a surface of the sheet of media 34. In another embodiment, for example, passive adjuster 88 may be fixed, i.e., merely provide a pivot point, wherein guide member 50 may be leveled in relation to a surface of the sheet of media 34 by actuation of active adjuster 86.

Drive mechanism 89 is drivably coupled to active adjuster 86 and may include, for example, an electrically driven actuator, such as a motor or solenoid communicatively coupled to controller 24, or may include a mechanically driven actuator, such as a ratchet mechanism, that is operated by being repeatedly bumped by printhead carrier 36, that rotates the eccentric cam of active adjuster 86, which may be followed by the eccentric cam of passive adjuster 88 in some embodiments, to lift or lower guide member 50.

Figure 2:
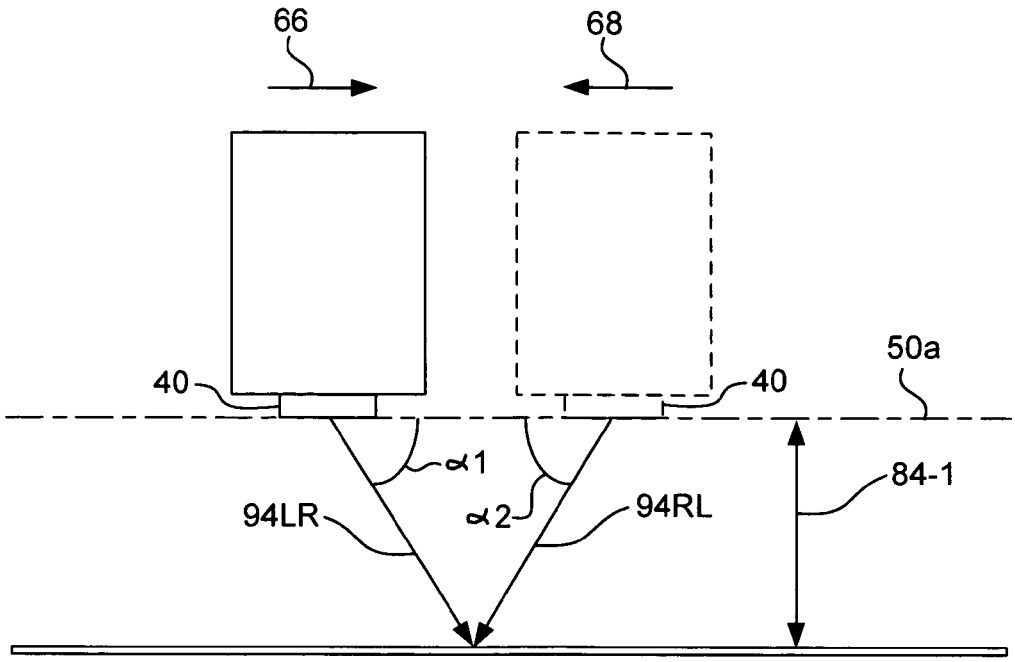
FIG. 2 is an exaggerated diagrammatic representation of a bi-directional alignment of a printhead at a first printhead gap.

FIG. 2 shows an exaggerated diagrammatic representation of a bi-directional alignment of printhead 40 at a first printhead gap 84-1, with printhead 40 displaying no bi-directional alignment error. Since printhead 40 is transported by printhead carrier 36 at a linear left-to-right carrier velocity in direction 66 and a linear right-to-left carrier velocity in direction 68, there is in effect an ejection angle (e.g., angles $\alpha 1$ and $\alpha 2$) with respect to horizontal axis 50*a* even though the actual angle of ink ejection is perpendicular to printhead 40 (e.g., if stationary). Thus, the ink drop angle alpha (angles $\alpha 1$ and $\alpha 2$) is dependent on drop velocity in relation to carrier velocity. Angles $\alpha 1$ and $\alpha 2$ will remain constant as long as the carrier velocity of printhead carrier 36 is constant and the print pattern is the same. Accordingly, with printhead 40 positioned at a first printhead gap 84-1, an ink drop leaving printhead 40 at angle $\alpha 1$ will have an ink flight distance 94LR and an ink drop leaving printhead 40 at angle $\alpha 2$ will have an ink flight distance 94RL. In this example, distances 94LR and 94RL are equal, but in opposite directions. Also, in this example angles $\alpha 1$ and $\alpha 2$ are substantially equal, but in opposite directions.

Figure 3:
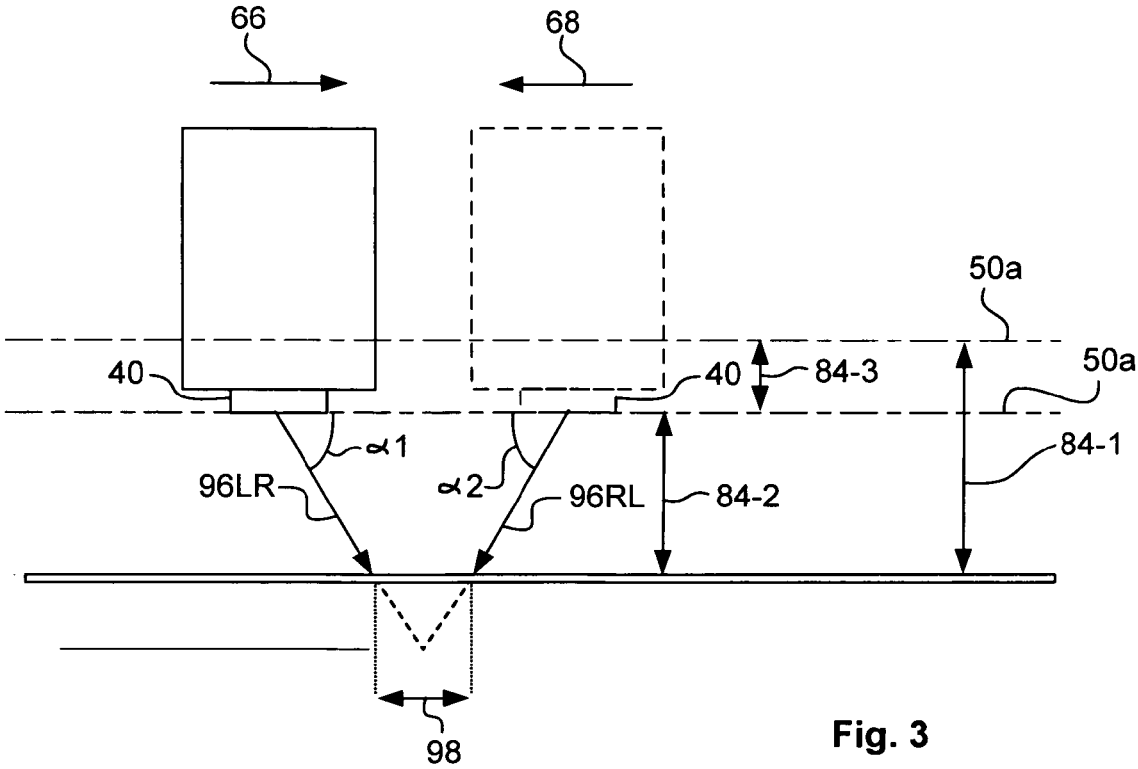
FIG. 3 is an exaggerated diagrammatic representation of a bi-directional misalignment of a printhead at a second printhead gap.

FIG. 3 shows an exaggerated diagrammatic representation of a bi-directional misalignment of printhead 40 at a second printhead gap 84-2, smaller than printhead gap 84-1 by a printhead gap change amount 84-3, and having an ink flight distance 96LR at angle α1 with respect to horizontal axis 50*a* and an ink flight distance 96RL at angle α2 with respect to horizontal axis 50*a*. In this example, distances 96LR and 96RL are substantially equal, but in opposite directions. Also, angles α1 and α2 are substantially equal, but in opposite directions. However, distances 96LR and 96RL of FIG. 3 are shorter than distances 94LR and 94RL of FIG. 2, resulting in a bi-directional printhead alignment error distance 98.

Figure 4:
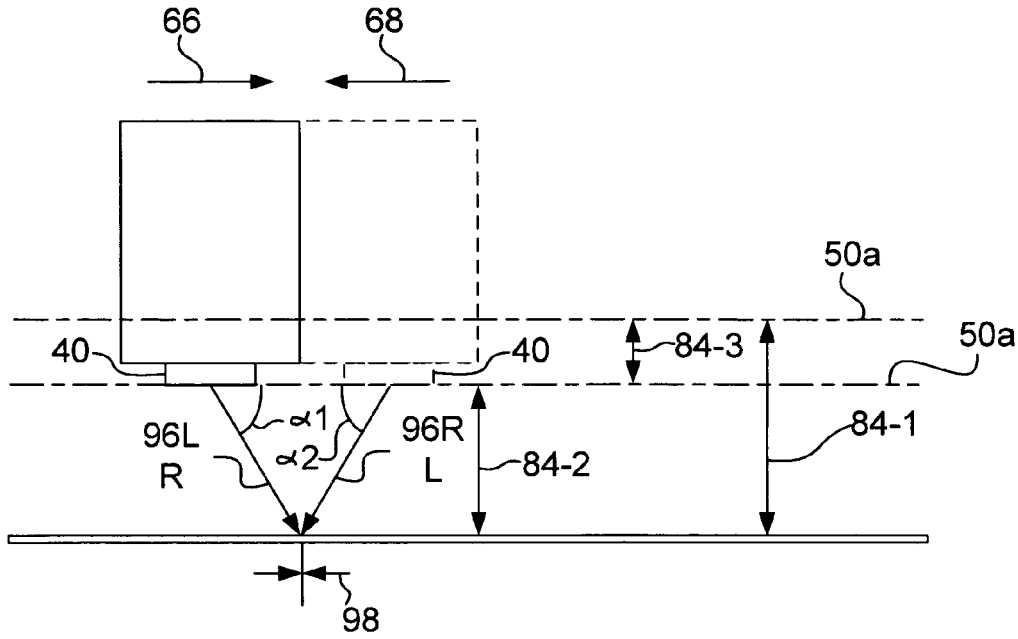
FIG. 4 is a diagrammatic illustration of the correction of bi-directional misalignment after the printhead gap was changed to the printhead gap of FIG. 3.

FIG. 4 is a diagrammatic illustration of the correction of bi-directional misalignment after the printhead gap was changed to the printhead gap of FIG. 3. In particular, FIG. 4 shows that when the printhead gap 84 is reduced to second printhead gap 84-2 from printhead gap 84-1 by the printhead gap change amount 84-3, a new bi-directional alignment value is required to correct for bi-directional misalignment and achieve optimum print quality. By determining the optimum bi-directional printhead alignment values for two different gap heights, e.g., printhead gap 84-1 and printhead gap 84-2, and by knowing the printhead gap change amount 84-3, i.e., the vertical offset distance, between the two gap heights of printhead gap 84-1 and printhead gap 84-2, then either of the actual gap heights for printhead gap 84-1 and printhead gap 84-2 may be calculated without measuring, or knowing, either of printhead gap 84-1 or printhead gap 84-2, by using trigonometric principles, as illustrated in FIG. 5.

Figure 5:
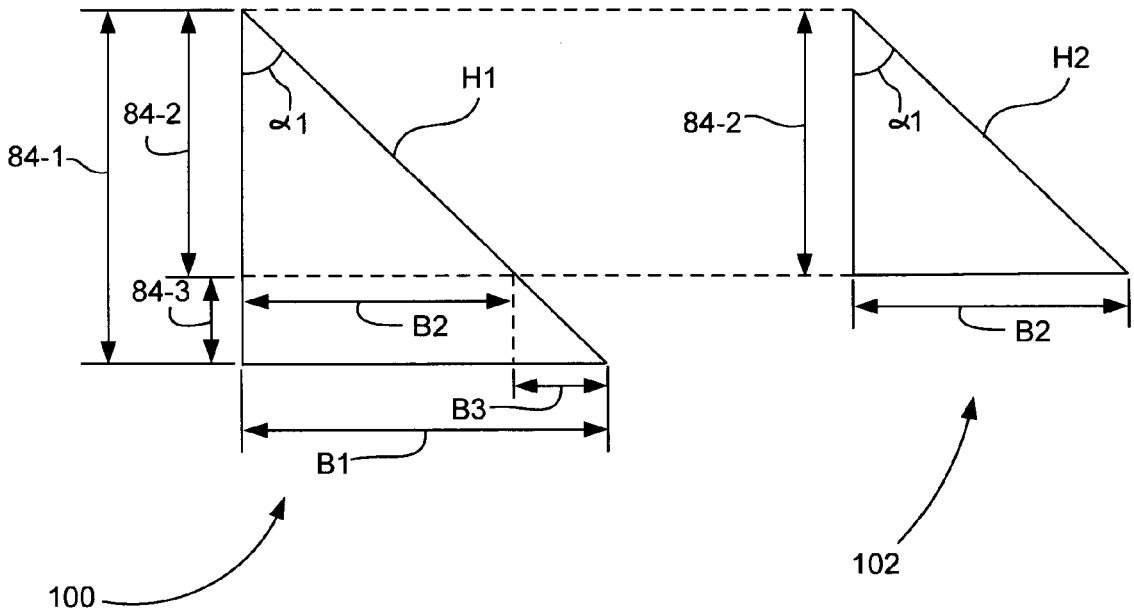
FIG. 5 is a trigonometric illustration of how an unknown printhead gap may be determined based on bi-directional misalignment amounts, in accordance with the present invention.

FIG. 5 shows a pair of right triangles 100, 102. Right triangle 100 represents the unknown printhead gap (GAP 1) corresponding to the printhead gap 84-1 of FIG. 2 and right triangle 102 represents the unknown printhead gap (GAP2) corresponding to the printhead gap 84-2 of FIG. 3. The hypotenuse Hi of right triangle 100 represents the ink flight distance 94LR, which is unknown. The printhead gap change amount (ΔGAP) corresponding to segment 84-3 is known. Also, the hypotenuse H2 of right triangle 102 represents the ink flight distance 96LR, which is unknown. The base B1 of right triangle 100 represents one-half of the first amount of bi-directional misalignment (BIDIB1), i.e., (BIDIB1)/2, of printhead 40 at the first unknown printhead gap GAP1, i.e., printhead gap 84-1 of FIG. 2. The base B2 of right triangle 102 represents one-half of the second amount of bi-directional misalignment (BIDIB2), i.e., (BIDIB2)/2 of printhead 40 at the second unknown printhead gap GAP2, i.e., printhead gap 84-2 of FIG. 3. The base distance B3 represents one-half of the difference (ΔBIDI), i.e., (ΔBIDI)/2 between the first amount of bi-directional misalignment BIDIB1 and the second amount of bi-directional misalignment BIDIB2.

Figure 6:
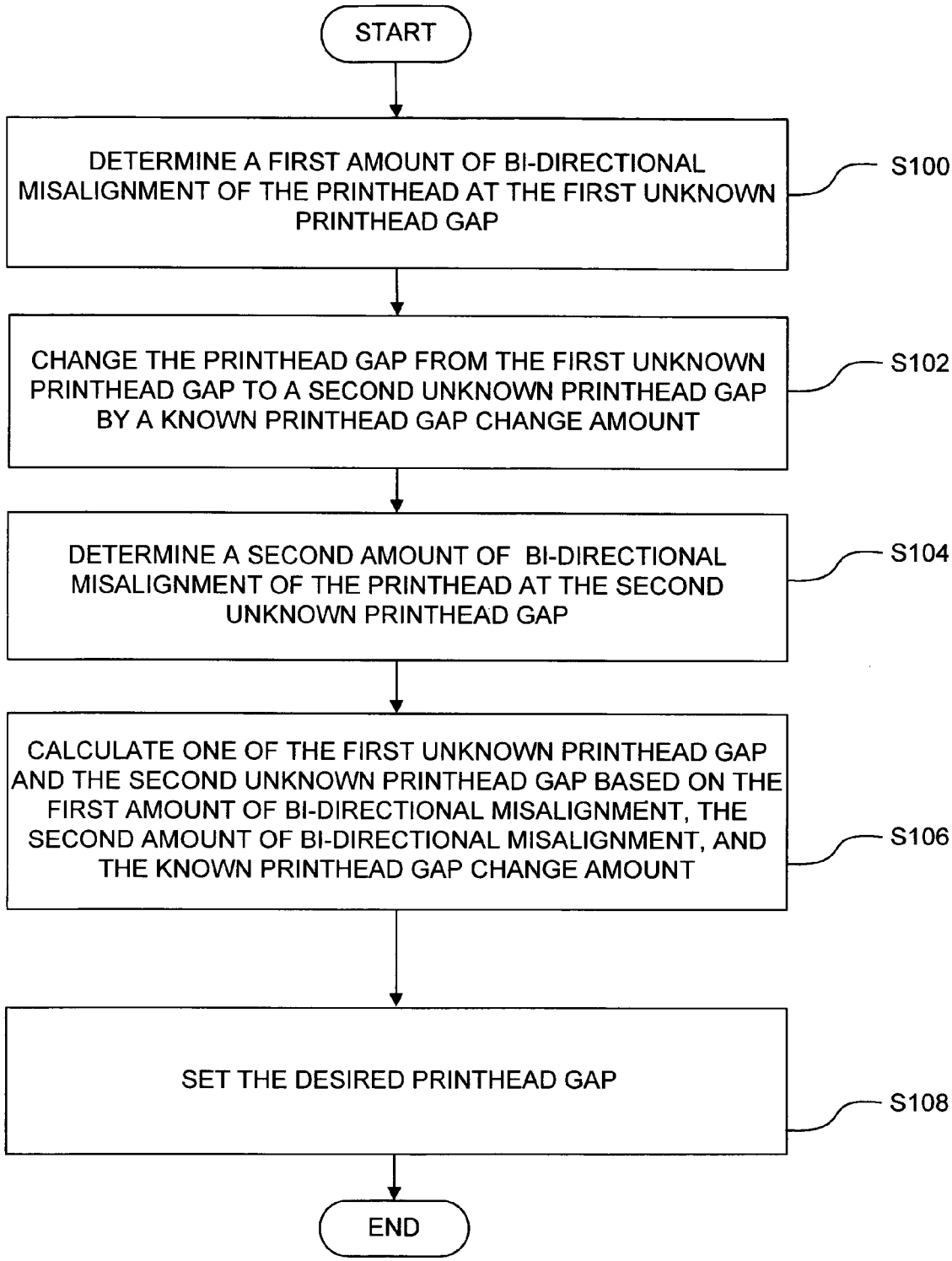
FIG. 6 is a flowchart for a method for determining a printhead gap between a printhead and a sheet of media in an ink jet apparatus that performs bi-directional alignment of a printhead, in accordance with the present invention.

In view of the above, FIG. 6 is flowchart for a method for determining a printhead gap 84 between a printhead, such as printhead 40, and a sheet of media 34 in ink jet apparatus 12 that performs bi-directional alignment of printhead 40, in accordance with the present invention. The method may be performed, for example, in ink jet apparatus 12 by program instructions executed by controller 24. Once the method is started, the method may be completed by controller 24 automatically without user intervention.

At step S100, a first amount of bi-directional misalignment BIDIB1 of printhead 40 is determined at the first unknown printhead gap GAP1. The first amount of bi-directional misalignment BIDIB1 of printhead 40 may be determined, for example, using a technique well known in the art, wherein a first bi-directional alignment pattern is printed on the sheet of media 34 and the first bi-directional alignment pattern is scanned by printhead alignment sensor 46 to obtain the first amount of bi-directional misalignment BIDIB1, which may be represented as a time or distance offset i.e., a bi-directional alignment value, used to bring bi-directional printing into alignment.

At step S102, the printhead gap 84 is changed from the first unknown printhead gap GAP1 to a second unknown printhead gap GAP2 by a known printhead gap change amount ΔGAP. The change may be effected, for example, by controller 24 causing printhead gap adjustment mechanism 32 to move guide member 50 in one of directions 90 and 92. The printhead gap change amount ΔGAP may be stored for further use in memory associated with controller 24.

At step S104, a second amount of bi-directional misalignment BIDIB2 of printhead 40 is determined at the second unknown printhead gap GAP2. The second amount of bi-directional misalignment BIDIB2 of printhead 40 may be determined, for example, using the technique described above, wherein a second bi-directional alignment pattern is printed on the sheet of media 34 and the second bi-directional alignment pattern is scanned by printhead alignment sensor 46 to obtain the second amount of bi-directional misalignment BIDIB2, which may be represented as a time or distance offset, e.g., a bi-directional alignment value, used to bring bi-directional printing into alignment.

At step S106, one of the first unknown printhead gap GAP1 and the second unknown printhead gap GAP2 is calculated based on, e.g., using, the first amount of bi-directional misalignment BIDIB1, the second amount of bi-directional misalignment BIDIB2, and the known printhead gap change amount ΔGAP. The calculating may be performed, for example, by controller 24.

For example, with reference to FIG. 5, the unknown printhead gap GAP1 (e.g., 84-1) may be calculated based on knowing the printhead gap change amount ΔGAP (e.g., 84-3), the difference in bi-directional misalignment ΔBIDI (e.g., B3), and the amount of bi-directional misalignment BIDIB1 (e.g., B1), by using the equation:

$$GAP1=BIDIB1\times(\Delta GAP/\Delta BIDI) \qquad \text{Equation 1.}$$

Likewise, with reference to FIG. 5, the unknown printhead gap GAP2 (e.g., 84-2) may be calculated based on knowing the printhead gap change amount ΔGAP (e.g., 84-3), the difference in bi-directional misalignment ΔBIDI (e.g., B3), and the amount of bi-directional misalignment BIDIB2 (e.g., B2), by using the equation:

$$GAP2=BIDIB2\times(\Delta GAP/\Delta BIDI) \qquad \text{Equation 2.}$$

In accordance with the present invention, no distance measurements are taken between the printhead, such as printhead 40, and the sheet of media 34 in determining the printhead gap 84, i.e., either or both of the initial printhead gap 84-1 and the changed printhead gap 84-2 may be determined based upon bi-directional misalignment readings taken by printhead alignment sensor 46 and the known printhead gap change amount ΔGAP.

At step S108, the desired printhead gap, e.g., printhead gap 84, may be set based on knowing one of GAP1 (e.g., 84-1) and/or GAP2 (e.g., 84-2), and changing printhead gap by a desired change amount to achieve the desired printhead gap. For example, a desired printhead gap may be set based on knowing the second unknown printhead gap GAP2 as a result of the calculating, i.e., forming a known current printhead gap, and changing the known current printhead gap by a desired change amount to achieve the desired printhead gap.

The method above may be performed, for example, each time a new media type is used in ink jet apparatus 12, or when a media type used in ink jet apparatus 12 is changed. Once the printhead gap is known for a specific type of media, then the alignment values used in determining the printhead gap may be used for that specific type of media, or a common set of alignment values may be used and the printhead gap adjusted for a specific type of media.

By performing alignment on a specific type of media, such as for each media type used in ink jet apparatus 12, the printhead gap can be adjusted to be exactly the same for all media types, regardless of the thickness of the media. To measure the printhead gap height, the bi-directional printhead alignment pattern is printed at a carrier speed of printhead carrier 36 that achieves the desired resolution on the alignment value differences. In one exemplary embodiment, for example, the ink velocity may be on the order of 300 inches per second and the carrier velocities for printhead alignment pattern printing may be in the range of 40 to 60 inches per second, such that the angle alpha (angle $\alpha 1$ and angle $\alpha 2$) generated provides for a sufficient gap height change resolution for ink jet apparatus 12 to determine the absolute printhead gap height.

Those skilled in the art will recognize that the ideal carrier velocities for printhead alignment pattern printing in printhead gap determinations in accordance with the present invention may vary from those set forth in the example above, depending on a variety of factors, including the mechanical and control configurations of the ink jet apparatus. For example, by decreasing the angle alpha (angle $\alpha 1$ and angle $\alpha 2$), i.e., increasing the carrier speed of printhead carrier 36, better resolution on the alignment value differences may be achieved as the printhead gap changes.

In addition to the use of the present invention in adjusting a printhead gap to a desired printhead gap, the present invention may be used to determine the printhead gap at various points along the width of the sheet of media 34 in print/sense zone 64 by using multiple bi-directional alignment patterns, with each pattern being associated with a particular location along bi-directional scan path 52. As such, the present invention may be used to level guide member 50 with respect to the surface of the sheet of media 34 so as to maintain a uniform gap across the width of the sheet of media 34.

The foregoing description of several methods and embodiments of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A method for determining a printhead gap between a printhead and a sheet of media in an ink jet apparatus that performs bi-directional alignment of said printhead, comprising:

determining a first amount of bi-directional misalignment of said printhead at a first unknown printhead gap;

changing said printhead gap from said first unknown printhead gap to a second unknown printhead gap by a known printhead gap change amount;

determining a second amount of bi-directional misalignment of said printhead at said second unknown printhead gap; and calculating at least one of said first unknown printhead gap and said second unknown printhead gap based on said first amount of bi-directional misalignment, said second amount of bi-directional misalignment, and said known printhead gap change amount.

2. The method of claim 1, wherein said first amount of bi-directional misalignment is represented as a first bi-directional alignment value and said second amount of bi-directional misalignment is represented as a second bidirectional alignment value.

3. The method of claim 1, wherein said calculating is performed using the equation, GAP1=BIDIB1×(ΔGAP/ΔBIDI), wherein:

GAP1 is said first unknown printhead gap;

BIDIB1 is said first amount of bi-directional misalignment;

ΔGAP is said known printhead gap change amount; and

ΔBIDI is a difference in bi-directional misalignment amount between said first amount of bidirectional misalignment and said second amount of bi-directional misalignment.

4. The method of claim 1, wherein said calculating is performed using the equation, GAP2=BIDIB2×(ΔGAP/ΔBIDI), wherein:

GAP2 is said second unknown printhead gap;

BIDIB2 is said second amount of bi-directional misalignment;

ΔGAP is said known printhead gap change amount; and

ΔBIDI is a difference in bi-directional misalignment amount between said first amount of bi-directional misalignment and said second amount of bi-directional misalignment.

5. The method of claim 1, wherein a desired printhead gap is set based on knowing at least one of said first unknown printhead gap and said second unknown printhead gap after said calculating.

6. The method of claim 1, wherein a desired printhead gap is set based on s knowing said second unknown printhead gap, after said calculating, to form a known current printhead gap and changing said known current printhead gap by a desired change amount to achieve said desired printhead gap.

7. The method of claim 1, wherein said method is performed for a new media type used in said ink jet apparatus.

8. The method of claim 1, wherein said method is performed when a media type used in said ink jet apparatus is changed.

9. The method of claim 1, further comprising using said method to determine multiple printhead gaps along a width of said sheet of media.

10. The method of claim 1, wherein said printhead is mounted to a printhead carrier, said printhead carrier being supported by a guide rod coupled to a printhead gap adjustment mechanism, said method further comprising leveling said guide rod with respect to a surface of said sheet of media based on a result of said calculating.

11. A method for determining a printhead gap between a printhead and a sheet of media in an ink jet apparatus that performs bidirectional alignment of said printhead, comprising:

printing a first bi-directional printhead alignment pattern;

reading said first bi-directional printhead alignment pattern with a printhead alignment sensor to determine a first amount of bi-directional misalignment of said printhead at a first unknown printhead gap associated with said first bi-directional printhead alignment pattern;

changing said printhead gap from said first unknown printhead gap to a second unknown printhead gap by a known printhead gap change amount;

printing a second bi-directional printhead alignment pattern;

reading said second bidirectional printhead alignment pattern with said printhead alignment sensor to determine a second amount of bi-directional misalignment of said printhead at said second unknown printhead gap associated with said second bi-directional printhead alignment pattern; and calculating at least one of said first unknown printhead gap and said second unknown printhead gap based on said first amount of bi-directional misalignment, said second amount of bi-directional misalignment, and said known printhead gap change amount.

12. The method of claim 11, wherein said first amount of bi-directional misalignment is represented as a first bi-directional alignment value and said second amount of bi-directional misalignment is represented as a second bi-directional alignment value.

13. The method of claim 11, wherein said calculating is performed using the equation, GAP1=BIDIB1×(ΔGAP/ΔBIDI), wherein:

GAP1 is said first unknown printhead gap;

BIDIB1 is said first amount of bi-directional misalignment;

ΔGAP is said known printhead gap change amount; and

ΔBID1 is a difference in bi-directional misalignment amount between said first amount of bi-directional misalignment and said second amount of bi-directional misalignment.

14. The method of claim 11, wherein said calculating is performed using the equation, GAP2=BIDIB2×(ΔGAP/ΔBIDI), wherein:

GAP2 is said second unknown printhead gap;

BIDIB2 is said second amount of bi-directional misalignment;

ΔGAP is said known printhead gap change amount; and

ΔBIDI is a difference in bi-directional misalignment amount between said first amount of bi-directional misalignment and said second amount of bi-directional misalignment.

15. The method of claim 11, wherein a desired printhead gap is set based on knowing at least one of said first unknown printhead gap and said second unknown printhead gap after said calculating.

16. The method of claim 11, wherein a desired printhead gap is set based on knowing said second unknown printhead gap, after said calculating, to form a known current printhead gap and changing said known current printhead gap by a desired change amount to achieve said desired printhead gap.

17. The method of claim 11, wherein said method is performed for a new media type used in said ink jet apparatus.

18. The method of claim 11, wherein said method is performed when a media type used in said ink jet apparatus is changed.

19. The method of claim 11, further comprising using said method to determine multiple printhead gaps along a width of said sheet of media.

20. The method of claim 11, wherein said printhead and said printhead alignment sensor are each mounted to a printhead carrier, said printhead carrier being supported by a guide rod coupled to a printhead gap adjustment mechanism, said method further comprising leveling said guide rod with respect to a surface of said sheet of media based on a result of said calculating.

* * * * *